United States Patent [19]

Harrison et al.

[11] Patent Number: 5,070,551

[45] Date of Patent: Dec. 10, 1991

[54] SHOWER CURTAIN LINER WITH ENCLOSURE ASSEMBLY

[76] Inventors: S. Kaye Harrison, 77 W. Viking Dr., Cordova, Tenn. 38018; Judith M. Payne, 373 Mart's Way Cove, Collierville, Tenn. 38017

[21] Appl. No.: 521,426

[22] Filed: May 10, 1990

[51] Int. Cl.[5] ..... A47K 4/00

[52] U.S. Cl. ..... 4/608

[58] Field of Search ..... 4/608, 558, 607, 610

[56] References Cited

U.S. PATENT DOCUMENTS

| | | | |
|---|---|---|---|
| 2,303,502 | 12/1942 | Rous | 4/608 X |
| 3,063,749 | 11/1962 | Strubb et al. | 4/608 X |
| 3,632,154 | 1/1972 | Woodrich | 4/558 |
| 3,808,610 | 5/1974 | Mertensen | 4/558 |
| 4,077,072 | 3/1978 | Dazura | 4/558 X |
| 4,594,741 | 6/1986 | Payne | 4/608 X |
| 4,825,481 | 5/1989 | Lonberger | 4/608 |

*Primary Examiner*—Henry J. Recla
*Assistant Examiner*—Robert M. Fetsuga
*Attorney, Agent, or Firm*—Banner, Birch, McKie & Beckett

[57] ABSTRACT

A plurality of wall fasteners are positioned along the vertical edges of a shower curtain. The wall fasteners maintain the edges of the shower curtain in contiguity with the shower walls between which the curtain is hung. Thus, the water spray from the shower can not splash past the edges of the shower curtain and the enclosure walls. The fasteners mate with a corresponding fastener on the shower curtain. Approximately the entire vertical edges of the curtain is, thus, sealed against the shower walls to thereby prevent any water from escaping.

18 Claims, 1 Drawing Sheet

SHOWER CURTAIN LINER WITH ENCLOSURE ASSEMBLY

BACKGROUND OF THE INVENTION

The present invention generally relates to the field of bathroom fixtures and assessories, and more particular, is directed to a shower curtain liner with an enclosure assembly which greatly reduces the likelihood of water escaping from the shower and onto the floor and surrounding areas.

Shower curtains and liners are available in a wide variety of shapes and sizes. In the most common arrangement, a decorative shower curtain is used in combination with a waterproof liner. The curtain usually is kept outside of the bath tub or shower area while the liner is tucked inside and serves as a barrier to prevent the shower water from escaping. In some applications, the curtain is itself made of waterproof material or is laminated with a waterproof layer and serves the dual purpose of a decorative shower enclosure and a liner. As used herein, and except where noted, the term "curtain" is intended to mean both a shower curtain with integral waterproofing and the combination of a curtain and separate liner.

In most installations, the shower curtain hangs from a horizontal bar above the tub or shower enclosure and may be pushed aside for entry and exit. The curtain usually hangs below the ceiling level so that there is a large open space over the shower curtain. This space results in the movement of air and moisture between the shower enclosure and the room in which the shower is located. The movement of air causes an accumulation of moisture in the surrounding room which tends to condense on the walls, mirrors, and other surfaces which may be damaged by the moisture. One structure which addresses this problem is a solid plastic sheet which permits no air movement and thus confines all of the air and moisture within the shower enclosure. While such a structure is ideal with respect to preventing the escape of the moisture into the room, it creates an undesirable ventilation condition within the shower enclosure itself.

Another problem encountered with most existing shower curtain arrangements is the tendency for the curtain to billow as a result, not only of direct impingement of water spray, but also as a result of air turbulence created by the spray. Such billowing can cause the bottom of the shower curtain to rise above the side of the bath tub or the curb or ridge of the shower room floor and allow the water to splash out of the tub or stall. There also is a tendency for the inside vertical adjacent curtain edges to separate from the opposing walls, further allowing water to escape from the shower enclosure into the room. Attempts have been made to eliminate these problems, by for example, the addition of weights to the bottom hem of the curtain or the use of magnets in the hem which attach to the tub walls. These problems have also been addressed in the prior art by the use of various zipper and hanger-bracket arrangements. The various solutions proposed by the prior art have, for the most part, been found to be complicated, expensive and not a fully satisfactory answer to the problem. Accordingly, there is a need in the art for a more simplified and economical solution to the problem of water inadvertently escaping from shower areas.

SUMMARY OF THE INVENTION

It is the overall objective of the present invention to provide a shower curtain assembly which is effective in preventing water from escaping from a shower area.

It is a specific object of the present invention to provide a shower curtain assembly meeting the above overall objective which is economical to manufacturer and is low in cost.

It is another specific object of the present invention to provide a shower curtain assembly meeting the above overall objective which is easily to install.

It is a still further specific object of the present invention to provide a shower curtain assembly meeting the above overall objective which can be fabricated in the home from a conventional shower curtain.

The above and other objects of the present invention are achieved by providing a plurality of wall fasteners along the vertical edges of the shower curtain. The wall fasteners maintain the edges of the shower curtain in contiguity with the shower walls between which the curtain is hung. Thus, the water spray can not splash past the edges of the shower curtain and the enclosure walls.

The fasteners mate with a corresponding fastener on the shower curtain. Approximately the entire vertical edges of the curtain is, thus, sealed against the shower walls to thereby prevent any water from escaping.

Various advantages and features of novelty which characterize the present invention are pointed out with particularly in the claims annexed hereto and forming a part of this application. However, for a better understanding of the invention, its advantages, and objects obtained by its use, reference should be had to the drawings and to the accompanying descriptive matter in which there is illustrated and described a preferred embodiment of the invention.

BRIEF DESCRIPTION OF THE PREFERRED EMBODIMENT

Figure 1:
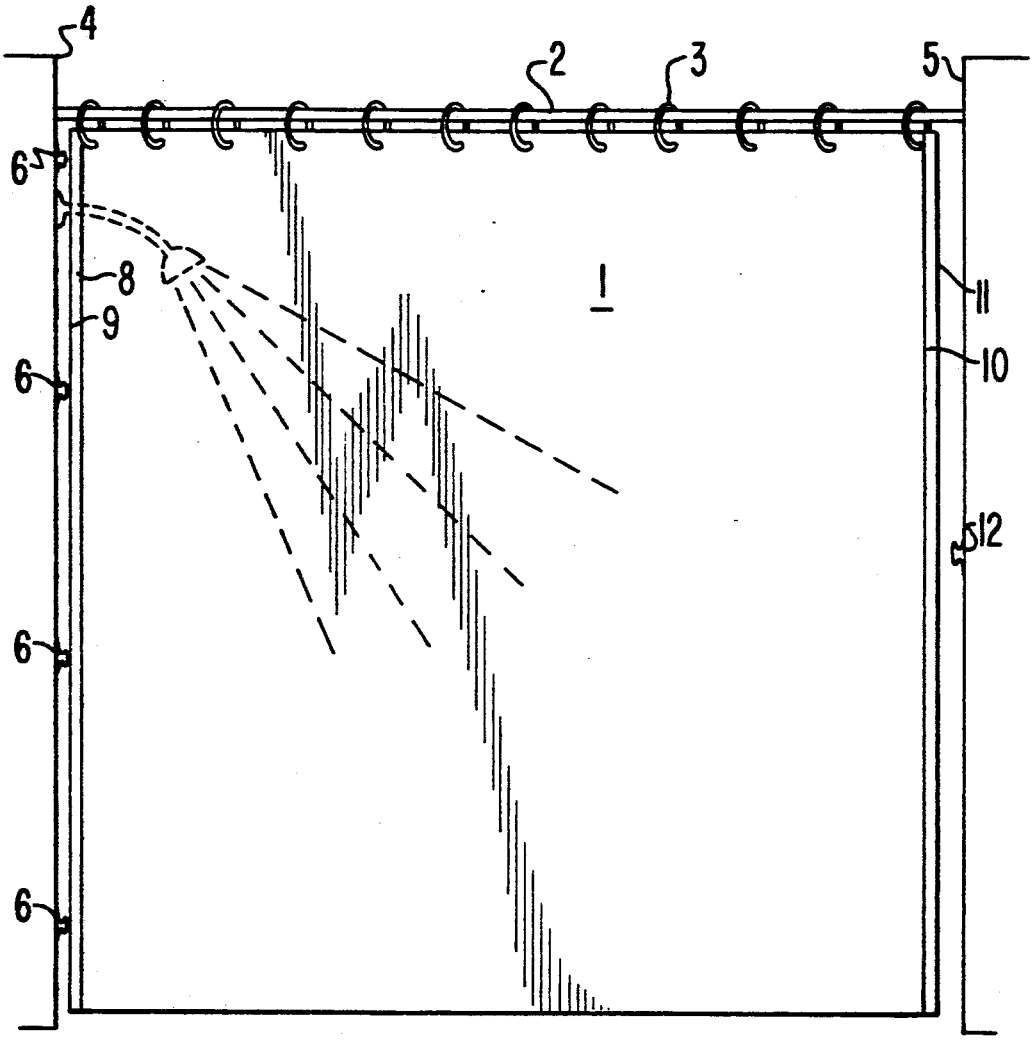
FIG. 1 is a front elevational view of a shower curtain/liner in accordance with the present invention.

FIG. 1 illustrates the shower curtain/liner with the enclosure assembly of the present invention. As described herein, applicants' invention is shown in conjunction with a curtain which has an integral water proof liner. The invention also applies to a separate shower curtain liner. Thus the term "curtain" as used herein also is intended to mean "liner".

Curtain 1 is supported by a curtain rod or pole 2 positioned between walls 4 and 5 of the shower area. Curtain 1 is secured to pole 2 by a plurality of ring fasteners 3 which allow the curtain to slide along pole 2 for entering and exiting the shower. Pole 2 and fasteners 3 are formed as is well known in the prior art.

Figure 2:
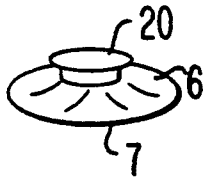
FIG. 2 is a perspective view of a fastening device used to attach the curtain/liner of applicants' invention to a shower wall.

As illustrated in FIG. 1, a plurality of wall fasteners 6 are secured to wall 4. These wall fasteners may be secured to wall 4 by a variety of adhesive materials or may be attached by other fasteners, such as screws, nails and the like. Fasteners 6 may also take the form of suction cups as shown in FIG. 2 which are held to wall 4 by the vacuum gripping action of cup portion 20 of the cup. As further illustrated in FIG. 2, the outward surface 7 of each of fasteners 6 is covered with a contact adhering material which adheres on contact with a companion surface covered with the same type of material. A hook/loop fabric material, such as VELCRO, may be used to provide this feature.

As shown in FIG. 1, fasteners 6 are spaced approximately equidistance apart and mate with a strip 8 attached to vertical edge 9 of curtain 1. The outward surface of strip 8 is covered with the same contact adhering material as is used on fasteners 6 so that when fasteners 6 are brought into contact with strip 8, the relative surfaces immediately adhere. Thus edge 9 of curtain 1 is held securely against wall 4.

The number of fasteners 6 positioned along wall 4 may also be varied depending on the height of curtain 1. Where the height is large, more fasteners will be needed. Strip 8 may be sewn onto curtain 1 at the time that the curtain is manufactured or may be applied subsequently by a heat activated adhesive or virtually any other adhesive material. The use of a heat activated material is ideal since it would permit strip 8 to be applied to curtain 1 using a household iron to in effect iron strip 8 onto curtain 1.

As further shown in FIG. 1, a second strip 10 is attached to vertical edge 11 of curtain 1. The outward surface of strip 10 also is covered with a contact adhering material which mates with fastener 12 on opposed wall 5. Strip 10 and faster 12 are formed in the same manner as respective strip 8 and fasteners 6 are formed and applied to curtain 1 and wall 4. Applicants have found that a single fastener 12 may be used on wall 5, which is away from the shower head, rather than the plurality of fasteners 6 on wall 4. In some applications, though, it may be necessary to use more than one fastener 12 on wall 5 in order to achieve the ideal securing of curtain 1 to both walls 4 and 5.

Numerous characteristics and advantages of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention as illustrated by annexed claims.

We claim:

1. A shower curtain assembly for use with a shower enclosure, said assembly comprising:

a shower curtain having a first edge;

a first fastener attached to said first edge of said shower curtain;

a second fastener adapted for attachment to said enclosure and for mating with said first fastener, wherein said second fastener is attached to said enclosure and mated to said first fastener, said first edge of said shower curtain is held in intimate contact with said enclosure;

said first fastener is attached to a substantial portion of said first edge of said shower curtain and said second fastener mates to said first fastener over said substantial portion of said first edge;

said first fastener is formed of a strip along said first edge of said shower curtain;

said second fastener is formed of a plurality of individual fastener means for mating to said first fastener over said substantial portion of said first edge;

said first and said second fasteners include a contact adhering surface which adheres together when said first fastener is mated to said second fastener;

said first fastener is attached to said first edge of said shower curtain by an adhesive material;

said contact adhering surface is formed of a hook/loop fabric; and each said individual fastener means comprises a suction cup, said hook/loop fabric contact adhering surface of said second fastener comprising a separate piece of hook/loop fabric connected to each of said suction cups, said suction cups being generally evenly spaced proximate said first edge of said shower curtain.

2. The shower curtain assembly of claim 1, wherein said hook/loop fabric is VELCRO.

3. The shower curtain assembly of claim 1, wherein said adhesive material is heat activated.

4. The shower curtain assembly of claim 1, wherein said shower enclosure includes first and second substantially vertical walls and said shower curtain includes a second edge, said first and second edges of said shower curtain being substantially parallel to each other and correspond to respective said first and second vertical walls of said enclosure.

5. The shower curtain assembly of claim 4, wherein said first edge of said shower curtain is held in intimate contact with said first vertical wall.

6. The shower curtain assembly of claim 4, further including:

a third fastener attached to said second edge of said shower curtain; and a fourth fastener adapted for attachment to said enclosure and for mating with said third fastener, wherein when said fourth fastener is attached to said enclosure and mated to said third fastener, said second edge of said shower curtain is held in intimate contact with said enclosure.

7. The shower curtain assembly of claim 6, wherein said third fastener is attached to a substantial portion of said second edge of said shower curtain and said fourth fastener mates to said third fastener over said substantial portion of said second edge.

8. The shower curtain assembly of claim 7, wherein said third fastener is formed of a strip along said second edge of said shower curtain.

9. The shower curtain assembly of claim 8, wherein said fourth fastener is formed of a plurality of individual fastener means for mating to said third fastener over said substantial portion of said second edge.

10. The shower curtain assembly of claim 9, wherein said third and said fourth fasteners include a contact adhering surface which adheres together when said third fastener is mated to said fourth fastener.

11. The shower curtain assembly of claim 10, wherein said contact adhering surface is formed of a hook/loop fabric.

12. The shower curtain assembly of claim 11, wherein said hook/loop fabric is VELCRO.

13. The shower curtain assembly of claim 8, wherein said third fastener is attached to said second edge of said shower curtain by a heat activated adhesive material.

14. A shower enclosure assembly comprising:

a) a generally rectangular flexible shower curtain having a generally linear first edge and an opposite generally linear second edge;

b) a shower enclosure having a generally vertical first wall adjacent said generally linear first edge and a second wall adjacent said second edge, said enclosure having a shower head proximate said first wall;

c) an elongated strip having a flexible hook/loop fastening fabric on the front side and an adhesive on the back side which attaches said strip to said curtain, and said strip spanning a substantial portion of said curtain and having a generally linear first edge along the length of said strip aligned with said generally linear first edge of said shower curtain;

d) a plurality of suction cups adhered by vacuum force to said generally vertical first wall of said enclosure, said suction cups having a concave suction surface and a convex rearward surface, and said suction cups being generally evenly spaced along said first wall adjacent said generally linear first edge of said curtain;

e) a flexible hook/loop fastening fabric adhered directly to the material of said suction cup on a portion of said suction cup at the convex side thereof;

f) said flexible hook/loop fastening fabrics of said strip and said suction cups capable of adhering to one another upon contact, said vacuum force being greater than the adhering force of said flexible hook/loop fastening fabrics;

g) the length of said elongated strip being substantially greater than the width of said suction cups such that a user may place the strip in contact with at least one of said suction cups even with substantial vertical misalignment of said curtain;

h) said adhesive on said back side of said strip covering a sufficiently large surface area such that the adhesive force therefrom is greater than said adhering force of said flexible hook/loop fastening fabrics.

15. The shower enclosure assembly of claim 14 wherein the lowermost edge of said curtain is free from attachment such that said curtain is freely moved upon the release of said curtain from said plurality of suction cups on said first wall.

16. The shower enclosure assembly of claim 15 further comprising one or more second suction cups adhered to said second wall of said enclosure, and a flexible hook/loop fastening fabric adhered directly to the material of said second suction cups; a second elongated strip having a flexible hook/loop fastening fabric on the most part of the front side and an adhesive on the back side attaching said second strip along said generally linear second edge of said curtain; and said flexible hook/loop fastening fabrics of said second strip and said second suction cups capable of adhering to one another upon contact.

17. The shower enclosure assembly of claim 16 wherein there are four said suction cups adhered to said first wall and one said second suction cups adhered to said second wall.

18. The shower enclosure assembly of claim 14 wherein said adhesive on the back side of said strip is heat activated.

* * * * *